US006835117B1

(12) United States Patent
Wang et al.

(10) Patent No.: US 6,835,117 B1
(45) Date of Patent: Dec. 28, 2004

(54) ENDPOINT DETECTION IN CHEMICAL-MECHANICAL POLISHING OF PATTERNED WAFERS HAVING A LOW PATTERN DENSITY

(75) Inventors: Xinhui Wang, Poughkeepsie, NY (US); Leping Li, Poughkeepsie, NY (US); Yingru Gu, Pougheepsie, NY (US); Hung-Chin Guthrie, Saratoga, CA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/707,120

(22) Filed: Nov. 21, 2003

(51) Int. Cl.[7] ..... B24B 49/00
(52) U.S. Cl. ..... 451/8; 451/60; 451/446
(58) Field of Search ..... 451/8, 57, 60, 451/65, 446, 447

(56) References Cited

U.S. PATENT DOCUMENTS 6,117,779 A * 9/2000 Shelton et al. ..... 438/692
6,176,765 B1 1/2001 Li et al.
6,214,732 B1 * 4/2001 Easter et al. ..... 438/690
6,254,453 B1 * 7/2001 Li et al. ..... 451/8
6,287,171 B1 * 9/2001 Meloni ..... 451/5
6,291,351 B1 9/2001 Li et al.
6,440,263 B1 8/2002 Li et al.
6,569,690 B1 * 5/2003 Houge et al. ..... 438/8

* cited by examiner

*Primary Examiner*—Dung Van Nguyen
(74) *Attorney, Agent, or Firm*—Jay H. Anderson

(57) ABSTRACT

A chemical-mechanical polishing (CMP) system and method includes pumping polishing slurry from a CMP apparatus through a sampling tube to an endpoint detection apparatus during a polishing operation, and flushing the sampling tube while a polishing operation is not in progress. The flushing of the sampling tube is commenced in accordance with a control signal from the endpoint detection apparatus terminating the polishing operation; the flushing is terminated in accordance with a starting signal to the CMP apparatus. The pump, which pumps a sample of slurry into the endpoint detection apparatus, continuously pumps slurry and/or water. Clogging of the slurry sampling tube is thus eliminated, thereby ensuring robust operation of the CMP apparatus. Contamination of the sampling tube is also avoided, so that the system may reliably provide sensitive endpoint detection and process control, even when a film of low pattern density is polished.

18 Claims, 5 Drawing Sheets

ENDPOINT DETECTION IN CHEMICAL-MECHANICAL POLISHING OF PATTERNED WAFERS HAVING A LOW PATTERN DENSITY

BACKGROUND OF INVENTION

This invention relates to the fabrication of electronic devices, and more particularly to improvement of process control in chemical-mechanical polishing (CMP) processes used in fabrication of semiconductor structures or ferromagnetic read/write heads.

In the field of semiconductor processing, CMP is a widely used technique for planarization of material and controlled removal of a layer of material from a stack of films on a substrate. A typical application of CMP is shown schematically in FIGS. 1A–1C. FIG. 1A illustrates a layer of material 1 deposited on an underlying layer of material 2 and overlying structures 3, prior to planarization of layer 1. As layer 1 is polished down, the top surfaces 3*a* of some of the structures are exposed, as shown in FIG. 1B (that is, a portion of the pattern defined by structures 3 is revealed). The CMP process continues until all the structures 3 have their top surfaces 3*b* exposed (FIG. 1C); this is the endpoint of the process.

A typical CMP apparatus 20 is shown in FIG. 2. A workpiece 10 (such as a silicon wafer with one or more layers deposited thereon) is held face down by a wafer carrier 11 and polished using a polishing pad 12 located on a polishing table 13; the workpiece is in contact with slurry 14. The wafer carrier 11 is rotated by a shaft 15 driven by a motor 16. The entire surface of the workpiece is polished by the polishing pad in the presence of the slurry.

In CMP processes generally, it is extremely important to stop the process at a desired predetermined location in the film or stack of films. Overpolishing (removing too much) of a film renders the workpiece unusable for further processing, thereby resulting in yield loss. Underpolishing (removing too little) of the film requires that the CMP process be repeated, which is tedious and costly. Tight tolerances are often maintained on the heights of structures 3; this in turn means that the endpoint must be precisely determined, and the process must then be promptly stopped. Moreover, as shown in FIGS. 1A–1C, the target surfaces for the process (that is, surfaces 3*b*) are often only a small fraction of the area of the whole wafer (as small as 2% in the case of NiFe structures with an overlying $Al_2O_3$ film, as in fabrication of magnetic write heads, for example in a P2 process). An endpoint detection and process control system for such a very low pattern density must detect the exposure of this small area, and do so with high accuracy and in real time.

In one conventional approach to the CMP endpoint detection problem, the thickness of the layer to be removed and the polishing rate are measured for each workpiece, in order to determine a desired polishing time; the CMP process is run for this length of time and then stopped. Since many different factors influence the polishing rate, and the polishing rate itself can change during a process, this approach is far from satisfactory.

More recently, CMP endpoint detection methods have been described which are based on slurry collection, sampling and analysis. A slurry sample 17, shown schematically in FIG. 2, is removed from the CMP apparatus by a slurry collector 21 and conducted through a delivery tube 21*a* into an analyzer unit 22. The analyzer unit determines whether the endpoint has been reached, based on changes in the composition of the slurry or in the concentration of a reaction product derived therefrom. A device for collecting slurry samples from the apparatus is described in U.S. Pat. No. 6,176,765, "Accumulator for slurry sampling." As an example of an endpoint detection method based on slurry sample analysis, U.S. Pat. No. 6,440,263, "Indirect endpoint detection by chemical reaction and chemiluminescence," describes analysis of the concentration of ammonia gas produced in the slurry when a silicon nitride film is exposed by polishing and chemically reacts with the slurry. This particular technique may be employed in polishing a variety of structures. For example, U.S. Pat. No. 6,291,351, "Endpoint detection in chemical-mechanical polishing of cloisonné structures," discloses a CMP $Al_2O_3$ film removal process in which a nitride film is deposited on top of NiFe structures, so that ammonia production indicates that the desired interface between the NiFe and $Al_2O_3$ has been reached. The disclosures of all three of the above-noted patents are incorporated herein by reference.

A variety of analysis techniques have been suggested in addition to the chemiluminescence approach described in the '263 patent. These include atomic emission spectroscopy and mass spectroscopy for elemental analysis of polishing residues dissolved in the slurry, as is understood by those skilled in the art. All of the various detection and analytical techniques face the same difficulty: delivering accurate, reliable performance in a manufacturing environment.

In order to be useful in a manufacturing environment where processing typically is performed 24 hours a day, a CMP slurry-sampling endpoint detection apparatus must satisfy two requirements: (1) The apparatus must operate continuously, with minimal need for operator supervision and minimal downtime for cleaning or maintenance; this is sometimes termed the "robustness" requirement. (2) The apparatus must monitor and control film removal in situ and in real time (with process control in response to endpoint within 1 second), even when the pattern density is as small as 2%; this is sometimes termed the "sensitivity" requirement. Since endpoint detection depends on analysis of slurry samples, the slurry must be sampled throughout the polishing process. However, sampling is generally conducted only while slurry is delivered to the polishing apparatus, and is interrupted when the polishing process stops. This means that the slurry delivery tube 21*a* often becomes clogged with stagnated or partially dried slurry during periods between polishing processes. In addition, the sampled slurry must be flushed out of the endpoint detection apparatus before the next workpiece is polished, so that newly-sampled slurry is not contaminated by slurry from the previous process. This problem is particularly acute when the pattern density is small; in some instances the polishing residues in the slurry from the target surfaces have concentrations below 1 ppm.

There remains a need for a slurry-sampling CMP endpoint detection apparatus which meets the robustness and sensitivity requirements, and in particular is suitable for detecting process endpoint in wafers with a low pattern density in a manufacturing environment.

SUMMARY OF INVENTION

The present invention addresses the above-described need by providing a CMP system and method for transporting slurry through a tube to an endpoint detection apparatus while a CMP apparatus is performing a polishing operation, and for flushing the slurry sample transport tube while the apparatus is not performing a polishing operation.

According to a first aspect of the invention, a method of performing CMP on a workpiece includes providing a slurry sampling tube for conducting slurry from the CMP apparatus to the endpoint detection apparatus; providing a slurry flushing apparatus for flushing slurry from the sampling tube; pumping slurry through the sampling tube in a slurry flow direction from the CMP apparatus into the endpoint detection apparatus while a polishing operation is in progress; and flushing the sampling tube while a polishing operation is not in progress. The flushing of the sampling tube is commenced in accordance with a control signal from the endpoint detection apparatus terminating the polishing operation; the flushing is terminated in accordance with a starting signal for the next polishing operation. The flushing apparatus includes a first flow control valve, and the flushing operation includes opening the valve to commence flushing when the polishing operation is terminated, and closing the valve to terminate flushing when a next polishing operation is commenced. The flushing apparatus also includes a second flow control valve (for example, a needle valve) for controlling a flow of water to the first control valve. During the flushing operation, a first portion of the water flow is pumped into the endpoint detection apparatus while a second portion of the water flow flushes the sampling tube in a flushing direction opposite the slurry flow direction. The slurry is collected from the CMP apparatus by a slurry collector, which also is flushed while the polishing operation is not in progress. The pumping is advantageously performed by a peristaltic pump which continuously pumps slurry and/or water.

According to a second aspect of the invention, a CMP system is provided which includes a slurry transport and flushing apparatus. This apparatus has a slurry collector for collecting slurry from the CMP apparatus during a polishing operation; a slurry sampling tube connecting the slurry collector and an endpoint detection apparatus; a first flow control valve, connected to the slurry sampling tube, for controlling a flow of water into the slurry sampling tube to flush slurry from the sampling tube while the polishing operation is not in progress; and a second flow control valve, connected to said first control valve by a flushing tube, for controlling the flow of water to the first control valve. The endpoint detection apparatus includes a pump (preferably a peristaltic pump) for pumping slurry through the slurry sampling tube during the polishing operation. The flow of water is effective to flush the sampling tube while the polishing operation is not in progress; a first portion of this flow is pumped into the endpoint detection apparatus, and a second portion of this flow flushes the tube in a direction opposite that of slurry flow during a polishing operation. The first flow control valve is opened when the polishing operation is terminated in accordance with an endpoint signal from the endpoint detection apparatus, and is closed when a next polishing operation is commenced in accordance with a starting signal. The first flow control valve is characterized as normally-open/active-closed, so that the valve is closed by an electrical signal in response to an electrical starting signal for starting a polishing operation.

DETAILED DESCRIPTION

Figure 3:
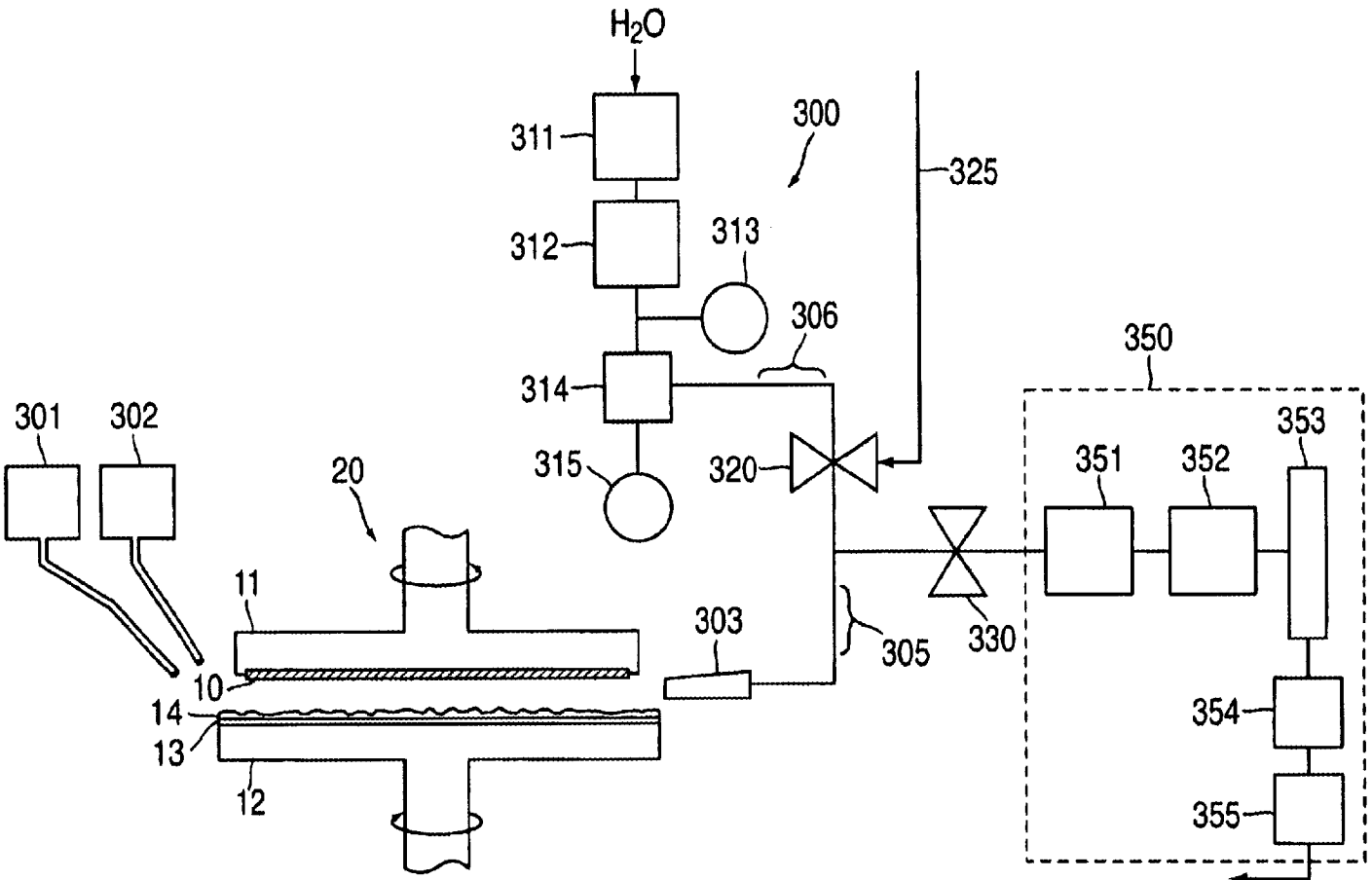
FIG. 3 schematically illustrates a CMP apparatus which incorporates slurry sampling and continuous pumping and flushing in the slurry sample transport tube, in accordance with an embodiment of the invention.

FIG. 3 illustrates a CMP system which embodies the present invention and which includes a polishing apparatus 20, slurry transport/flush apparatus 300 and endpoint detection and control unit 350. As noted above, in apparatus 20 the workpiece 10 is polished using polishing pad 13 located on a polishing table 12. A sample of slurry is transported to the detection/control unit 350, which detects the endpoint of the polishing process and generates an appropriate control signal 24.

During a polishing operation the workpiece is in contact with slurry 14 which covers the polishing pad. Slurry and water are dispensed onto the polishing pad by slurry dispenser 301 and water dispenser 302 respectively. Slurry collector 303 collects a sample of slurry which, as noted above, contains a small quantity of polishing residues and/or reaction products which may be analyzed to determine the process endpoint. The endpoint detection unit 350 includes a pump 351 (typically a peristaltic pump) for transporting the slurry sample from collector 303 through sampling tube 305 into the endpoint detection unit. The size of the tubing and speed of the pump, which together determine the flow rate into detection unit 350, are dictated by the maximum fluid intake rate of the analysis equipment (typically 5 ml/min in the case of ICP/AES).

As shown schematically in FIG. 3, valve 320 is electrically controlled; valve 320 is activated by the control signal for starting the CMP apparatus 20 (that is, the start signal for a polishing process also causes valve control signal 325 to activate the valve). Valve 320 is a "normally open/active closed" valve and is closed during a polishing operation. Valve 330 is normally open, and remains open until system maintenance is required.

Figure 1A:
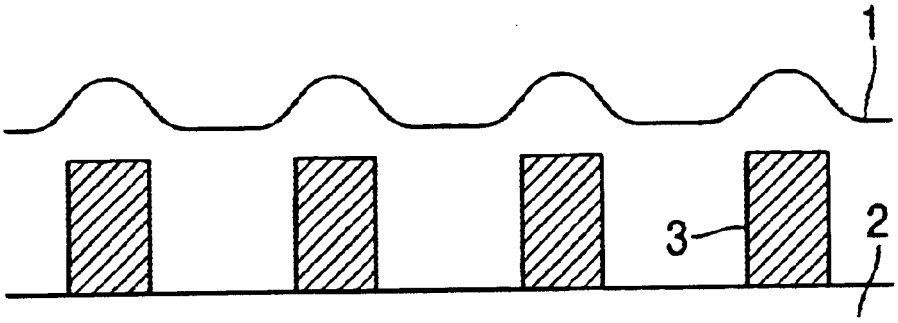
FIG. 1A (PRIOR ART)
FIGS. 1A–1C illustrate a typical CMP-based film removal process on a patterned wafer with a low pattern density.
Figure 1B:
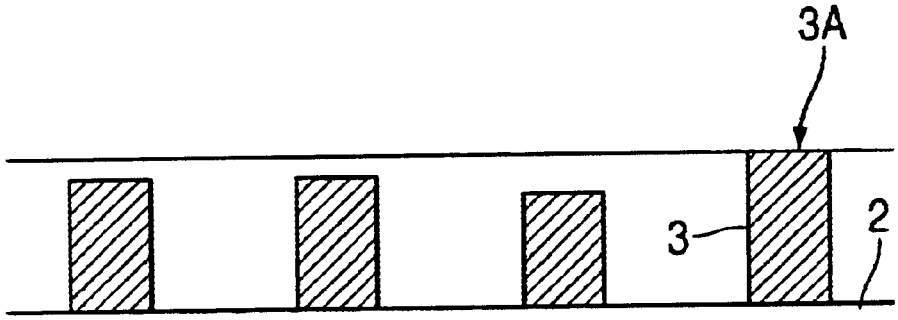
FIG. 1B (PRIOR ART)
Figure 1C:
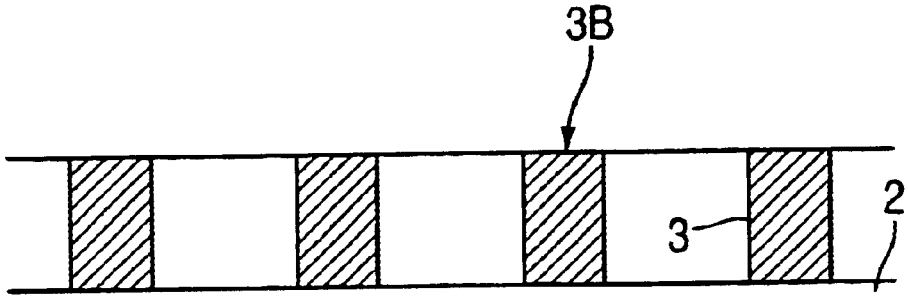
FIG. 1C (PRIOR ART)
Figure 2:
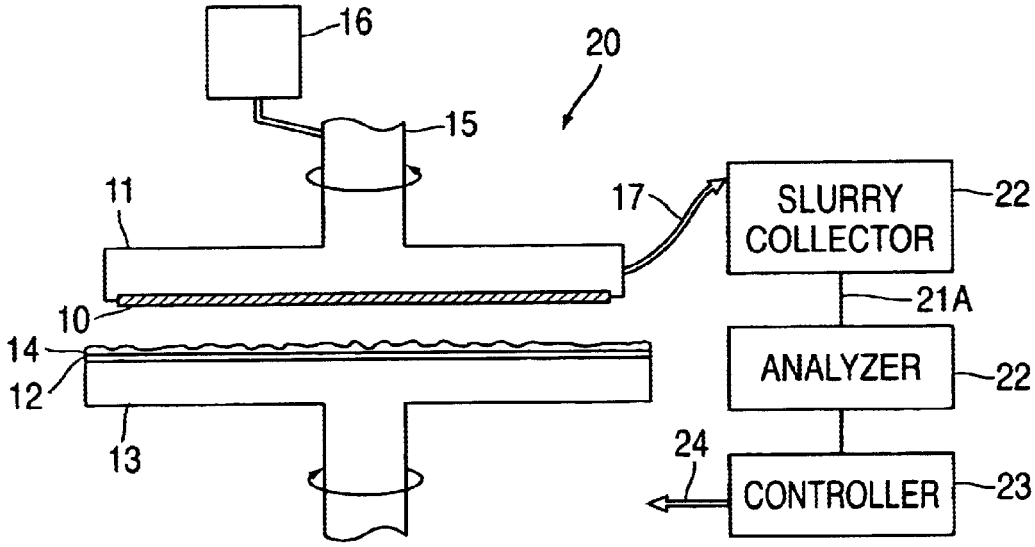
FIG. 2 (PRIOR ART)
FIG. 2 schematically illustrates a typical CMP apparatus in which a sample of slurry is collected and analyzed.

In this embodiment, the slurry sample is analyzed using an inductively coupled plasma (ICP) and atomic emission spectroscopy (AES). The sample is pumped into a nebulizer 352 and then transported into an ICP plasma chamber 353, where it is atomized within the plasma and excited to atomic and ionic states which are detected by AES unit 354. A small quantity of a particular element may be detected in the slurry sample using this technique. For example, in the process of FIGS. 1A–1C, if the target structures 3 are NiFe magnetic read/write heads and the overlying film 1 is $Al_2O_3$, the AES may be configured to detect Ni polishing residues in the slurry to indicate that the top surfaces of the target structures have been exposed. Alternatively, a sacrificial capping layer of some other element may be deposited on top of structures 3 (e.g. Mg on the NiFe heads). The appearance and subsequent disappearance of this element (as the capping layer is first exposed, then polished away) indicates that the polishing process endpoint has been reached.

The output of the AES unit is connected to a controller 355, which applies an appropriate endpoint control algorithm to determine when the process should be terminated, and then sends a control signal 24 to the apparatus 20 to end the polishing process.

The slurry transport/flush apparatus 300 permits slurry to be transported through sampling tube 305 into the detection/ control unit 350 while a polishing operation is in progress, and causes the slurry sampling tube to be flushed with water between polishing operations. Water is conducted through a filter 311 and a pressure regulator 312; the pressure in the water line is monitored by a pressure sensor 313. Pressure regulator 312 is adjusted to provide a water pressure adequate for flushing between polishing operations, as described in detail below. The water flow enters a "T" connection 314 which includes a variable orifice such as a needle valve, so that flow to valve 320 through flushing tube 306 is controlled by adjustment of the orifice; excess water flows into sink 315.

Figure 4A:
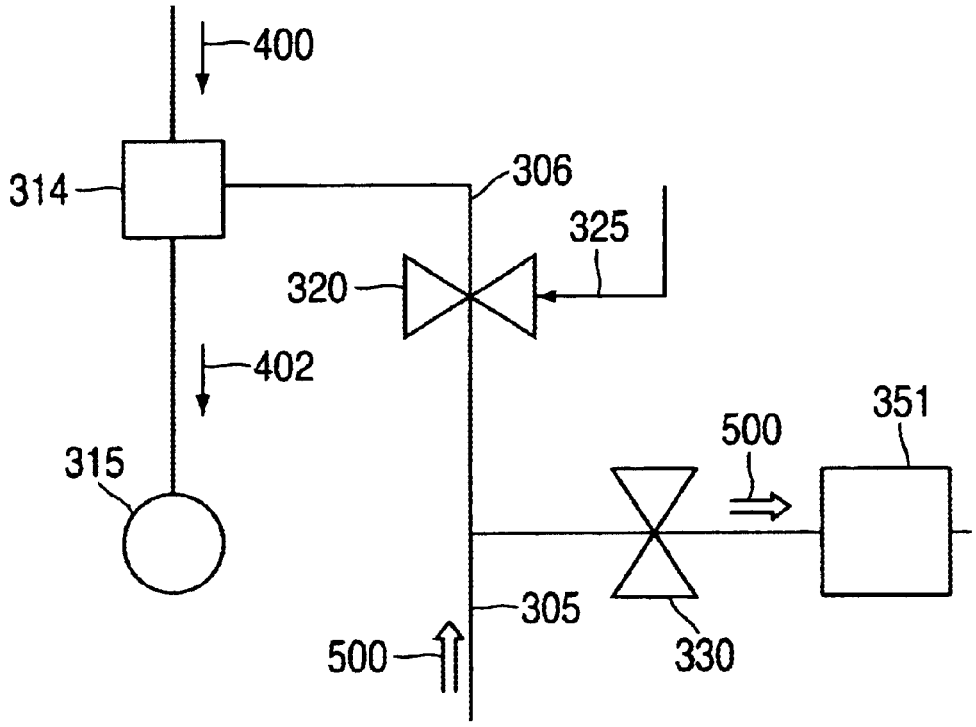
FIG. 4A is a detail view of FIG. 3, illustrating slurry transport during a polishing process, in accordance with an embodiment of the invention.

Slurry transportation through apparatus 300 during a polishing operation is shown schematically in FIG. 4A. When a polishing operation is started, valve control signal 325 activates valve 320, causing valve 320 to close. The stream of filtered water is thus blocked from flowing through valve 320 and instead flows into sink 315; flow 400 entering the needle valve 314 is equal to flow 402 entering the sink. A stream of slurry, collected from the polishing apparatus, is pumped through tube 305 and valve 330 into the endpoint detection unit by the pump 351. The arrow 500 indicates the slurry flow direction through the sampling tube. (During normal system operation, when no maintenance is being performed, valve 330 remains open and pump 351 remains on.) Valve 320 is located so as to minimize dead space in the slurry sampling tube, which could be subject to contamination by stagnating slurry. The stream of slurry is then analyzed to detect the endpoint of the polishing process.

Figure 4B:
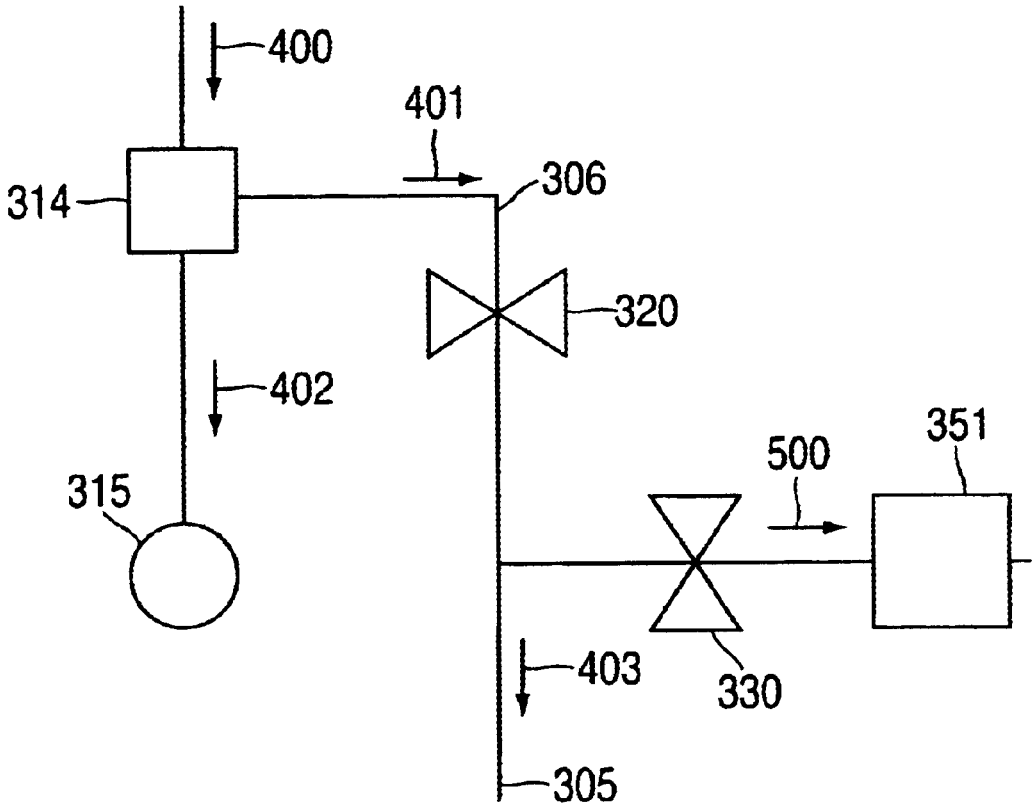
FIG. 4B is another detail view of FIG. 3, illustrating flushing of the slurry transport tube during a period between polishing processes, in accordance with an embodiment of the invention.

When the polishing operation is terminated, the slurry transport tube is flushed with water, as shown schematically in FIG. 4B. Valve 320 is deactivated and thus returns to its normally-open state. A flow of water 401 is established through tube 306 and valve 320 in accordance with the adjustment of valve 314. Valve 330 remains open and pump 351 remains on, so that a flow 404 of water (a first portion of flow 401) is pumped through valve 330 and enters the analyzer unit. Flow 404 is limited by the conductance of valve 330 and the capacity of pump 351 (that is, flow 404 represents the maximum fluid intake rate for unit 350). Flow 401 accordingly is chosen to be greater than flow 404, so that an excess flow 403 (a second portion of flow 401) flushes the sampling tube 305 in the reverse direction (that is, opposite arrow 500, back towards the slurry collector and through the slurry collector). As shown in FIG. 4B, the combination of water flows 401, 403 and 404 effectively flushes all parts of the slurry transport apparatus through which slurry is pumped during a polishing operation.

At the start of the next polishing operation, valve 320 is again closed. The water remaining in tube 305 is then pumped through valve 330 by pump 351 as the slurry stream enters the tube from the slurry collector 303.

It is noteworthy that during normal system operation, the slurry sampling tube has a fluid (either slurry or water) pumped through it at all times and is not exposed to the ambient, even when no polishing is being performed. Slurry in the tube is thus prevented from settling or drying, so that newly sampled slurry is not contaminated by background levels from the previous polishing operation. Furthermore, the entire slurry path from the collector to the analyzer is continuously flushed between polishing operations. By eliminating clogging of the slurry sampling tube, the above-described system ensures robust operation of the CMP apparatus. By avoiding contamination of the sampling tube, the system contributes to sensitive endpoint detection and thus reliable process control.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

We claim:

1. A method of performing chemical-mechanical polishing (CMP) on a workpiece using a CMP apparatus and an endpoint detection apparatus, the CMP apparatus performing polishing on the workpiece using a slurry, the method comprising the steps of:

providing a slurry sampling tube for conducting slurry from the CMP apparatus to the endpoint detection apparatus;

providing a slurry flushing apparatus for flushing slurry from the sampling tube;

pumping slurry through the sampling tube in a slurry flow direction from the CMP apparatus into the endpoint detection apparatus while a polishing operation is in progress; and flushing the sampling tube while a polishing operation is not in progress, wherein said flushing is commenced in accordance with a control signal from the endpoint detection apparatus terminating the polishing operation, and said flushing is terminated in accordance with a starting signal for a next polishing operation.

2. A method according to claim 1, wherein said flushing apparatus comprises a first flow control valve, and said flushing step further comprises opening the first flow control valve to commence said flushing when the polishing operation is terminated, and closing the first flow control valve to terminate said flushing when the next polishing operation is commenced.

3. A method according to claim 2, wherein the flushing apparatus further comprises a second flow control valve for controlling a flow of water to the first control valve, and during said flushing step a first portion of said flow is pumped into the endpoint detection apparatus while a second portion of said flow flushes the sampling tube in a flushing direction opposite said slurry flow direction.

4. A method according to claim 3, wherein the second flow control valve is a needle valve.

5. A method according to claim 3, wherein the endpoint detection apparatus has a maximum fluid intake rate, and further comprising the step of adjusting the second flow control valve so that said flow of water exceeds said maximum fluid intake rate, the first portion of said flow being equal to said maximum fluid intake rate.

6. A method according to claim 2, wherein the first flow control valve is characterized as normally-open/active-closed, so that said valve is closed by an electrical signal in response to an electrical starting signal for starting a polishing operation.

7. A method according to claim 1, wherein the sampling tube is connected to a slurry collector for collecting slurry from the CMP apparatus during the polishing operation, and said flushing step further comprises flushing the slurry collector while the polishing operation is not in progress.

8. A method according to claim 1, further comprising the step of:

detecting the endpoint of the polishing operation by analyzing the slurry pumped into the endpoint detection apparatus in said pumping step, said detecting being performed using an inductively coupled plasma (ICP) and atomic emission spectroscopy (AES).

9. A method according to claim 1, further comprising the step of pumping water into the endpoint detection apparatus while the polishing operation is not in progress.

10. A method according to claim 9, wherein said pumping steps are performed by a peristaltic pump which continuously pumps at least one of slurry and water.

11. A chemical-mechanical polishing (CMP) system for performing a polishing operation on a workpiece, the polishing operation being performed using a slurry in a CMP apparatus, the polishing operation being controlled in accordance with analysis of a sample of slurry in an endpoint detection apparatus, the system comprising:

a slurry transport and flushing apparatus including a slurry collector for collecting slurry from the CMP apparatus during the polishing operation, a slurry sampling tube connecting the slurry collector and the endpoint detection apparatus, a first flow control valve, connected to said slurry sampling tube, for controlling a flow of water into said slurry sampling tube to flush slurry from said sampling tube while the polishing operation is not in progress, and a second flow control valve, connected to said first control valve by a flushing tube, for controlling the flow of water to said first control valve;

wherein the endpoint detection apparatus includes a pump for pumping slurry through said slurry sampling tube during the polishing operation, the flow of water is effective to flush said sampling tube, said first flow control valve is opened when the polishing operation is terminated in accordance with an endpoint signal from the endpoint detection apparatus, and said first flow control valve is closed when a next polishing operation is commenced in accordance with a starting signal.

12. A CMP system according to claim 11, wherein said second flow control valve is a needle valve.

13. A CMP system according to claim 11, wherein during the polishing operation said pump pumps slurry in a slurry flow direction from the slurry collector into the endpoint detection apparatus, and while the polishing operation is not in progress said pump pumps a first portion of said flow of water into the endpoint detection apparatus while a second portion of said flow of water flushes the sampling tube in a flushing direction opposite said slurry flow direction.

14. A CMP system according to claim 13, wherein the endpoint detection apparatus has a maximum fluid intake rate, and said second flow control valve is adjusted so that said flow of water exceeds said maximum fluid intake rate, the first portion of said flow being equal to said maximum fluid intake rate.

15. A CMP system according to claim 13, wherein said pump is a peristaltic pump which continuously pumps at least one of slurry and water.

16. A CMP system according to claim 11, wherein the flow of water is effective to flush the slurry collector while the polishing operation is not in progress.

17. A CMP system according to claim 11, wherein the first flow control valve is characterized as normally-open/active-closed, so that said valve is closed by an electrical signal in response to an electrical starting signal for starting a polishing operation.

18. A CMP system according to claim 11, further comprising the endpoint detection apparatus, said apparatus including an inductively coupled plasma (ICP) chamber and an atomic emission spectroscopy (AES) unit.

* * * * *